US008028496B2

(12) United States Patent
Deckert et al.

(10) Patent No.: US 8,028,496 B2
(45) Date of Patent: Oct. 4, 2011

(54) GLUE APPLICATION DEVICE FOR A LABELING MACHINE

(75) Inventors: Lutz Deckert, Haltern am See (DE); Klaus Krämer, Dortmund (DE); Oliver Kress, Waltrop (DE)

(73) Assignee: KHS AG, Dortmund (DE)

( * ) Notice: Subject to any disclaimer, the term of this patent is extended or adjusted under 35 U.S.C. 154(b) by 279 days.

(21) Appl. No.: 12/249,545

(22) Filed: Oct. 10, 2008

(65) Prior Publication Data

US 2009/0095372 A1 Apr. 16, 2009

Related U.S. Application Data

(63) Continuation-in-part of application No. PCT/EP2007/002736, filed on Mar. 28, 2007.

(30) Foreign Application Priority Data

Apr. 11, 2006 (DE) ..... 10 2006 017 365

(51) Int. Cl.
*B65C 9/30* (2006.01)
*B05D 5/10* (2006.01)

(52) U.S. Cl. ..... 53/136.1; 53/415; 53/135.1; 156/578; 156/448; 156/566; 118/221; 118/231; 118/258

(58) Field of Classification Search ..... 53/415, 53/135.1, 135.2, 136.1; 156/578, 448, 458, 156/566, 568; 118/221, 231, 258, 259, 261, 118/262

See application file for complete search history.

(56) References Cited

U.S. PATENT DOCUMENTS

| | | | | |
|---|---|---|---|---|
| 2,229,621 | A * | 1/1941 | Bradner | 162/184 |
| 2,641,220 | A | 6/1953 | Weber et al. | |
| 2,787,244 | A | 4/1957 | Hickin | |
| 2,868,160 | A | 1/1959 | Paulsen | |
| 3,379,171 | A | 4/1968 | Cordingly et al. | |
| 3,762,365 | A | 10/1973 | Herzog | |
| 4,026,237 | A * | 5/1977 | Flanagan | 118/696 |
| 4,210,977 | A * | 7/1980 | Lillibridge | 15/306.1 |
| 4,347,095 | A | 8/1982 | Yamashita | |
| 4,693,210 | A | 9/1987 | DiFrank | |
| 4,761,200 | A | 8/1988 | Szeremeta | |
| 4,802,440 | A * | 2/1989 | Kronseder | 118/261 |
| 5,160,570 | A | 11/1992 | Dickey | |
| 5,167,749 | A * | 12/1992 | Kasak | 156/446 |
| 5,275,678 | A * | 1/1994 | West et al. | 156/215 |
| 5,443,683 | A * | 8/1995 | Garrett | 156/578 |
| 5,516,576 | A | 5/1996 | Varjian | |

(Continued)

FOREIGN PATENT DOCUMENTS

CA 2002844 5/1990

(Continued)

OTHER PUBLICATIONS

International Search Report PCT/EP2007/002736 and English translation thereof.

(Continued)

*Primary Examiner* — Hemant M Desai
(74) *Attorney, Agent, or Firm* — Nils H. Ljungman & Associates

(57) ABSTRACT

A beverage bottling plant, a labeling machine for use in a beverage bottling plant, and a glue application device for use with a labeling machine in a beverage bottling plant.

20 Claims, 6 Drawing Sheets

U.S. PATENT DOCUMENTS

| | | | | |
|---|---|---|---|---|
| 5,538,575 | A | 7/1996 | Hinton | |
| 5,916,414 | A * | 6/1999 | Kato et al. | 156/578 |
| 6,143,111 | A * | 11/2000 | Biagiotti | 156/152 |
| 2009/0255623 | A1 * | 10/2009 | Bagung et al. | 156/230 |

FOREIGN PATENT DOCUMENTS

| | | |
|---|---|---|
| DE | 12 40 775 | 5/1967 |
| DE | 34 42 995 | 6/1985 |
| DE | 37 24 196 | 2/1989 |
| DE | 38 39 100 | 5/1990 |
| DE | 40 35 091 | 5/1992 |
| DE | 44 31 276 | 3/1996 |
| DE | 92 18 941 | 5/1996 |
| DE | 199 26 956 | 12/2000 |
| DE | 694 30 631 | 12/2002 |
| DE | 202 20 132 | 4/2004 |
| EP | 0144198 | 7/1990 |
| JP | 2006 051 664 | 2/2006 |
| WO | WO 95/05900 | 3/1995 |

OTHER PUBLICATIONS

International Preliminary Report on Patentability PCT/EP2007/002736 and English translation thereof.

* cited by examiner

GLUE APPLICATION DEVICE FOR A LABELING MACHINE

CONTINUING APPLICATION DATA

This application is a Continuation-in-Part application of International Patent Application No. PCT/EP2007/002736, filed on Mar. 28, 2007, which claims priority from Federal Republic of Germany Patent Application No. 10 2006 017 365.1, filed on Apr. 11, 2006. International Patent Application No. PCT/EP2007/002736 was pending as of the filing date of this application. The United States was an elected state in International Patent Application No. PCT/EP2007/002736.

BACKGROUND

1. Technical Field

This present application relates to a beverage bottling plant, a labeling machine for use in a beverage bottling plant, and a glue application device for use with a labeling machine in a beverage bottling plant.

2. Background Information

Background information is for informational purposes only and does not necessarily admit that subsequently mentioned information and publications are prior art.

A bottling plant for filling bottles with a liquid beverage filling material generally may comprise a station to rinse bottles prior to filling, and a station to fill bottles. Filling may comprise a selection of different products that would be filled into corresponding bottles. A bottling plant also generally comprises a station to close bottles, a labeling station or machine to label bottles, and may comprise a containerization station.

The containers of which labels are to be attached are conveyed to a carousel conveyer that may be driven to rotate about its vertical axis and that has a plurality of rotatable receptors for the containers; conveying being done by known conveyer equipment, such as, for example, belt conveyers, a dividing screw conveyer, and an input star-wheel conveyer. Along the path through the labeling machine or station, the container performs one rotational movement, or several rotational movements. Upon the container having completed its passage through the labeling machine or station, the container is generally removed from the labeling machine or station by way of an output star-wheel conveyer and by a further belt conveyer.

Glue application devices for use in labeling machines, e.g. in the labeling units of such machines, are known in a wide variety of realizations and essentially comprise a glue application and spreading element which is generally in the shape of a rail and is thereby moved past a glue dispensing point of a glue application and spreading element, so that with the aid of a glue scraper, a uniform application of glue is produced on the gluing roller and is then transferred to the labels to be glued, and possibly either directly and/or indirectly by the application of glue to label palettes with which the labels are extracted from a label storage device.

OBJECT OR OBJECTS

An object of the present application is to create a glue application device which promotes a uniform application of glue that is independent of the production rate of the labeling machine and/or of the labeling unit. The present application teaches that this object is achieved by a glue application device with at least one gluing roller which can be driven in rotation around its roller axis, and with at least one glue application and spreading element with a glue dispensing point. The glue dispensing point is in communication with a connection for the delivery of the glue to apply glue on a cylindrical peripheral surface of the gluing roller that concentrically surrounds the roller axis and is moved past the glue dispensing point. The glue dispensing point is formed by a glue chamber which has the glue application and spreading element in the vicinity of a contact surface which is in contact against the peripheral surface of the gluing roller, and which is closed on its side facing the gluing roller by the peripheral surface of the gluing roller. The object may also be achieved by a glue application device with at least one gluing roller, which can be driven in rotation around its roller axis, and with at least one glue application and spreading element with a glue dispensing point. The glue dispensing point is in communication with a connection for the delivery of the glue to apply glue on a cylindrical peripheral surface of the gluing roller that concentrically surrounds the roller axis and is moved past the glue dispensing point. The glue application device comprises a glue buffer chamber which is in communication with the glue dispensing point at the gluing roller and holds a buffer volume of glue. The object may also be achieved by a glue application device with at least one gluing roller which can be driven in rotation around its roller axis, and with at least one glue application and spreading element with a glue dispensing point. The glue dispensing point is in communication with a connection for the delivery of the glue to apply glue on a cylindrical peripheral surface of the gluing roller that concentrically surrounds the roller axis and is moved past the glue dispenser. The glue application device comprises an overflow which is formed between the connection for the feed and delivery of the glue. The overflow is used for the removal of an excess quantity of glue that is not deposited on the gluing roller into an overflow duct, possibly into an overflow that leads into a glue reservoir that supplies the glue application device.

SUMMARY

One feature of the present application is a beverage bottling plant having a labeling machine with the glue application device. The beverage bottling plant may also comprise a filling machine and a closing and/or capping machine.

One feature of the present application is that the glue dispensing point of the glue application and spreading element is a glue chamber which is formed on a contact surface of the glue application and distribution element that is in contact with the gluing roller, and is closed on this contact surface by the gluing roller. Among other things, the desired uniform application of glue is promoted by the volume of glue contained in the glue chamber.

In an additional possible embodiment of the present application, the glue application and spreading element is a glue buffer chamber which is in communication with the glue dispensing point and is used to hold a certain volume of glue. This buffer chamber, among other things, also promotes a more uniform deposition of glue which is independent of the production rate of the labeling machine or of the labeling unit, and possibly even with a pulsed glue feed, for example via a glue pump which is realized in the form of a piston pump.

In an additional possible embodiment of the present application, in the communication between a connection for the feed of the glue and the glue applicator there is an overflow so that, for example, the quantity of glue that is fed via this connection can be selected so that it is slightly greater than the actual quantity of glue to be deposited on the gluing roller. This feature also makes possible, among other things, a more uniform glue deposition which is independent of the production rate of the labeling machine or of the labeling unit.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the present application are described according to at least one possible embodiment of the present application. The present application is explained in greater detail below with reference to one possible embodiment which is illustrated in the accompanying drawings, in which.

DESCRIPTION OF EMBODIMENT OR EMBODIMENTS

Figure 1:
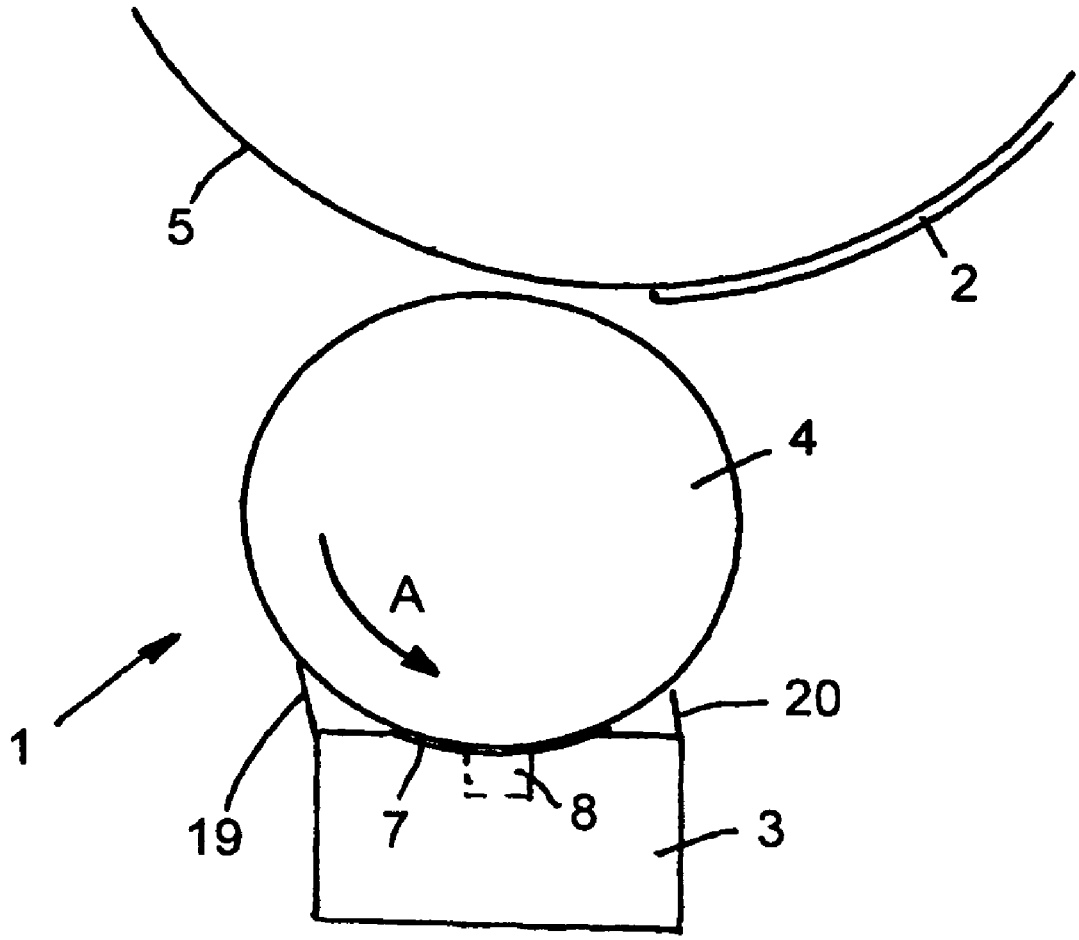
FIG. 1 is a schematic illustration of the glue application element and the gluing roller of a glue application device for labels, together with a label transfer cylinder (e.g. a vacuum cylinder) of a labeling unit or labeling machine, the remainder of which is not shown.
Figure 2:
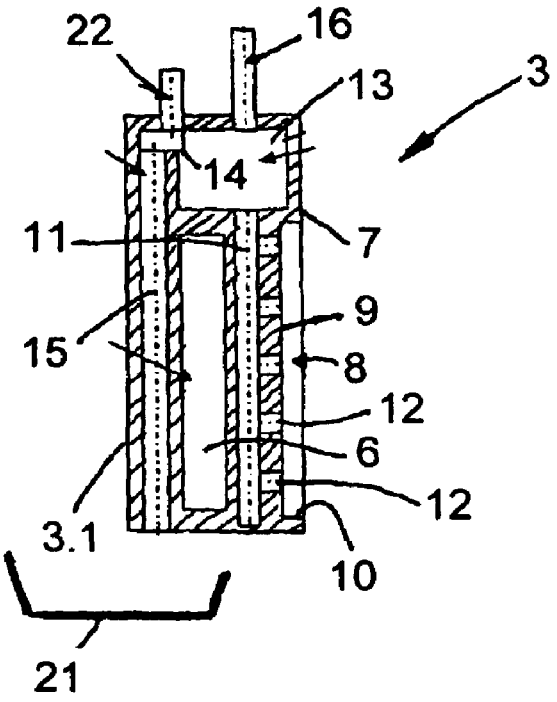
FIG. 2 is a schematic illustration of the glue application and spreading element.

In the figures, 1 is a glue application device of a labeling unit of a machine (not shown) for the labeling of bottles or similar containers. The glue application device may also be utilized to apply other types of adhesives used to label bottles or containers.

The glue application device comprises a glue application and spreading element 3, which is essentially in the form of a rail, and of the gluing roller 4 which is driven in circulation around a vertical roller axis, past which gluing roller the labels 2 that are to be provided with the label glue on the reverse side and are held on the periphery of a label transport cylinder 5 (vacuum cylinder) and/or the label palettes to be glued are moved, in a manner that is known to a technician skilled in the art.

The glue application and spreading element 3 has a rail-like housing 3.1 oriented with its longitudinal dimension parallel to the axis of the gluing roller 1, in which housing 3.1 there is, among other things, a heating device 6 and which, on one long side, forms a contact surface 7, against which the gluing roller 4 is in tight or almost tight contact with a portion of its cylindrical peripheral surface. For this purpose, the contact surface 7 is curved in the shape of a circular arc so that it corresponds to the cylindrical peripheral surface of the gluing roller 4. On the contact surface 7, the housing 3.1 is provided with an elongated recess, which is also oriented with its axis parallel or approximately parallel to the roller axis of the gluing roller 4 and forms a glue chamber 8, and possibly with a closed bottom 9 and a closed peripheral surface 10. On the contact surface 7, the glue chamber 8 is closed or covered by the gluing roller 4.

In the interior of the housing 3.1, a glue duct 11 is also realized which extends in the direction of the longitudinal axis of the rail-like housing 3.1, is closed on the underside of the housing 3.1 and empties into the glue chamber 8 by means of a plurality of openings or borings 12.

The upper end of the glue duct 11 empties into a glue buffer chamber 13, and possibly on the bottom of this chamber, which is provided in its upper area with an overflow 14, which also empties into a glue overflow or drainage duct 15 which extends in the direction of the longitudinal axis of the rail-like housing 3.1.

Figure 3:
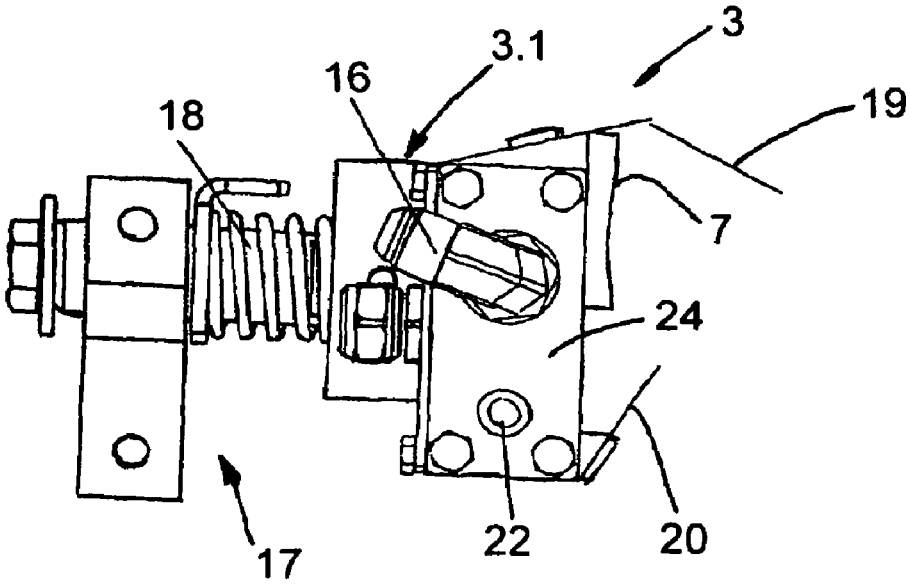
FIG. 3 is a plan view of the glue application and spreading element in greater detail.

On the upper side of the housing 3.1 there is also a connection 16 which is used for the feed of the glue and empties at the top into the glue buffer chamber 13. As shown in FIG. 3, the glue application and spreading element 3 and/or the housing 3.1 is held on a bracket 17 which is provided on the labeling machine (not shown) or on the labeling unit (not shown). The bracket 17 is realized so that the glue application and spreading element 3 can be pivoted completely or partially out of the way, e.g. for cleaning and maintenance purposes, so that when it is in the pivoted position, unobstructed access to the gluing roller 4 and the glue application and spreading element 3 itself are possible. The bracket 17 is further realized so that the glue application and spreading element 3 mates exactly or virtually exactly with the curved contact surface 7 against the gluing roller 4, and is possibly pressed against it by means of at least one compression spring, for example, a compression spring 18.

To one side of the contact surface 7, in the housing 3.1 there is also a trowel-like wiper 19. This wiper can be formed, for example, by a flexible plate to which a bias force is applied during operation and which is used for the removal of any remaining glue or any remaining parts of labels prior to the new application of glue. For this purpose, the wiper 19 is provided in the direction of rotation A of the gluing roller 4 upstream of the contact surface 7 and of the glue chamber 8.

On the housing 3.1, laterally with respect to the contact surface 7, but in the direction of rotation A of the gluing roller 4 downstream of the glue chamber, there is also a trowel-like glue scraper 20, which is used for the distribution and spreading of the glue deposited on the gluing roller 4, and with which the thickness of the glue deposit on the peripheral surface of the gluing roller 4 can be adjusted, and possibly by adjusting the gap formed between the glue scraper 20 and the gluing roller 4 by a corresponding setting of the glue application and spreading element 3. The glue scraper 20 can also be formed by a flexible plate, for example.

In other words, the glue scraper 20 disposes an even layer of glue on the gluing roller 4, which gluing roller 4 subsequently puts the disposed, even layer of glue on a label 2 to be adhered to a bottle. In one possible embodiment of the present application, the glue scraper 20 can be adjusted by an adjustment arrangement (not shown). The glue scraper 20 is adjusted in order to provide different thicknesses of glue on the gluing roller 4, depending on the thickness of glue desired for adhering labels 2.

During the operation of the gluing device 1, glue is continuously or substantially continuously transported by means of a glue pump (not shown) from a glue pan 21 to the connection 16, by means of which the glue chamber 8, the openings 12, the glue channel 11 and also the glue buffer chamber 13 are completely or virtually completely filled with glue. Excess glue which can no longer be held by the glue buffer chamber 13 travels via the overflow 14 into the glue overflow duct 15 and from there back into the glue pan 21. To make possible a bubble-free feed of the glue to the glue chamber 8 and to the glue buffer chamber 13, as well as the overflow of the excess glue into the overflow duct 15, a vent 22 is provided on the upper side of the glue buffer chamber 13, and in the illustrated embodiment directly above the overflow 14.

During operation, the glue chamber is continuously or virtually continuously filled with glue to its full depth, so that the gluing roller 4 which is moved past the open side of the glue chamber 8 is provided with a glue deposit over a width which corresponds to the longitudinal dimension of the glue chamber 8. The quantity of glue fed to the connection 16 can be, for example, slightly greater than the quantity of glue deposited on the gluing roller 4, so that a portion of the glue deposited flows back via the overflow 14 and the overflow duct 15 into the glue pan 21, and it is thereby promoted that a sufficient quantity of glue will always or substantially be present in the glue application and spreading element 3.

As a result of the volume of the glue chamber 8, and as a result of the buffer volume of the glue buffer chamber 13, in spite of the pulsed feed of the glue at the connection 16 by means of a glue pump which can be realized in the form of a piston pump, for example, a uniform application of glue on the gluing roller 4 is promoted which is independent of the production rate and of changes in the production rate of the labeling machine (number of containers to be labeled per unit of time).

Figure 4:
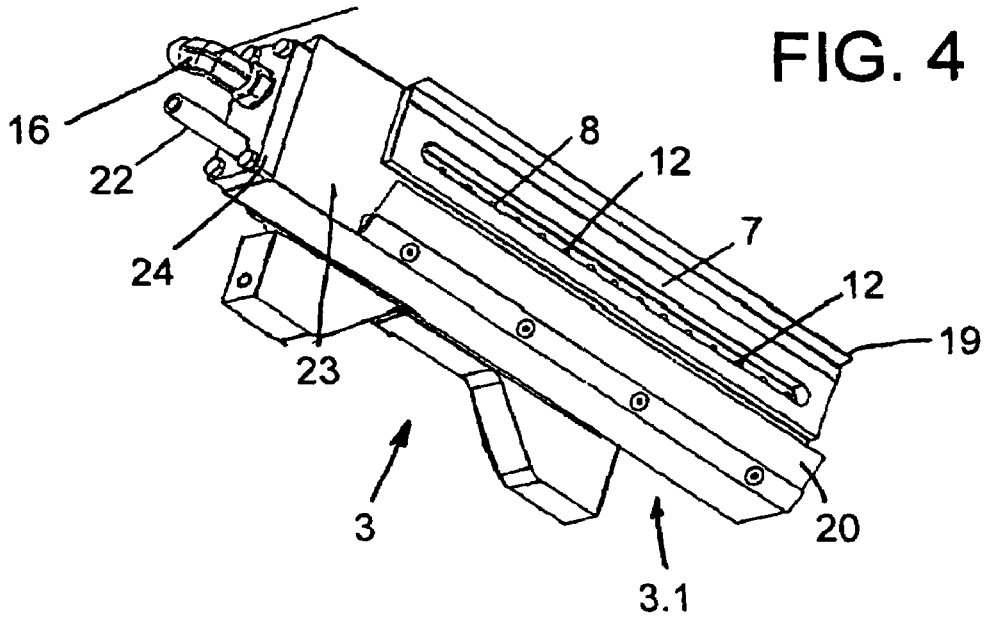
FIG. 4 is a perspective view of the glue application and spreading element.
Figure 5:
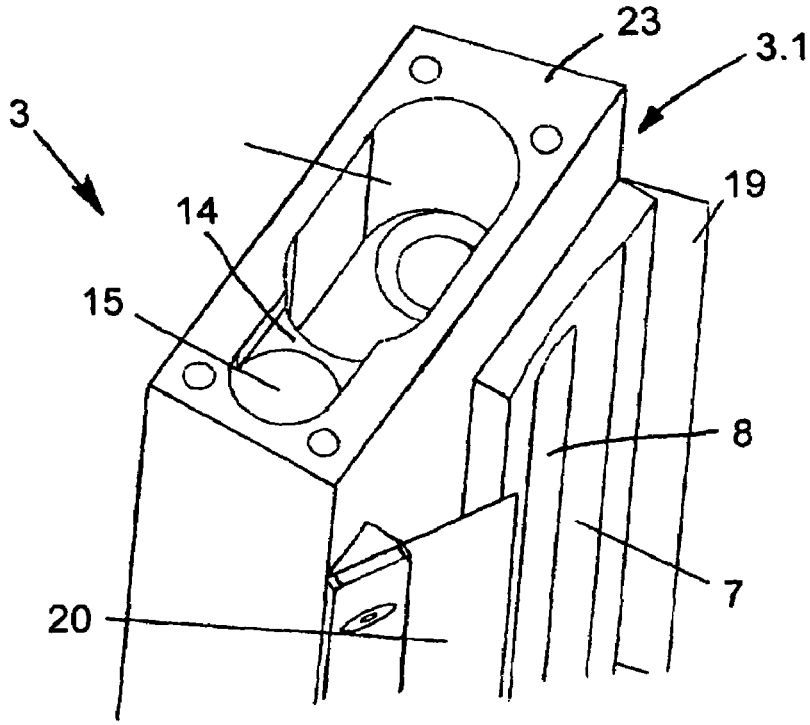
FIG. 5 is an enlarged illustration of the upper end of the glue application and spreading element with the cover that closes the glue buffer chamber removed.

FIGS. 3 through 5 show the glue application and spreading element 3 in greater detail. As shown in these figures, the housing 3.1 is formed by a block which is made of a suitable material such as metal, for example, in which a recess that forms the glue chamber 8, the openings or borings 12, the glue duct 11, the glue buffer chamber 13, the overflow 14 and the overflow duct 15 have been machined. The glue buffer chamber 13 formed by a recess in the upper end surface of the block 23 is closed by a cover 24 on which the connection 16 and the ventilation duct 22, among other things, are provided. The overflow 14 is thereby a laterally widened portion of the recess which forms the glue buffer chamber 13, into which (widened portion) the overflow duct 15 empties.

Figure 6:
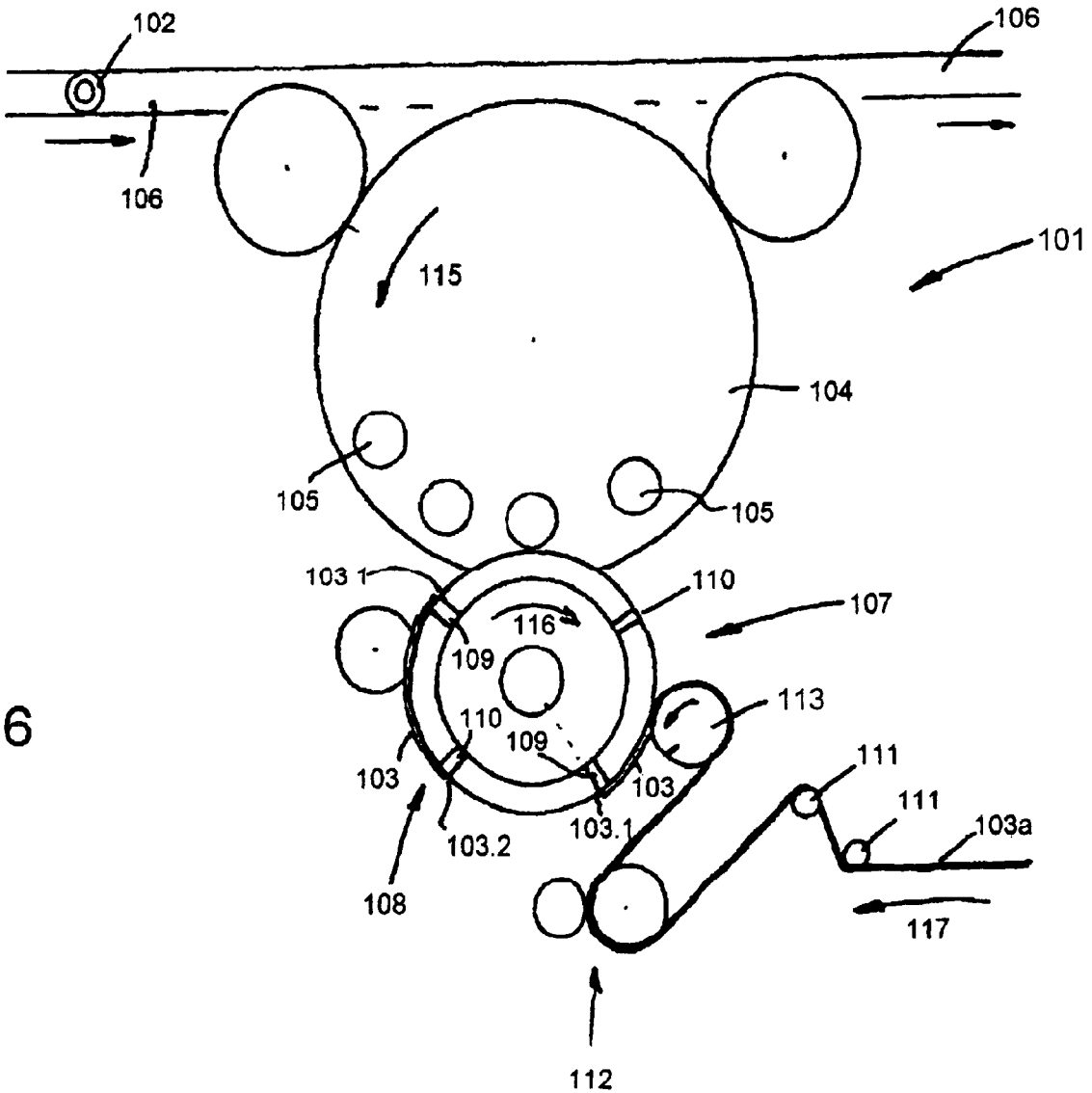
FIG. 6 is a schematic diagram showing an overhead view of a portion of the labeling unit of a labeling machine for labeling.

FIG. 6 shows one possible embodiment of a labeling machine 101 for use according to the present application, in the form of a rotary machine for the labeling of bottles 102, i.e. for the application of labels 103 on bottles 102. The labeling machine 101 used for this purpose comprises a rotor 104 that is driven in rotation in the direction indicated by the arrow 115 around a vertical machine axis with a plurality of support surfaces that are formed on the periphery of the rotor and formed by turntables 105. The bottles 102 to be labeled are fed to the rotor 104 via a conveyor 106 at a bottle inlet so that one bottle 102 is standing upright on each turntable 105, i.e. with its bottle axis FA oriented in the vertical direction. With the rotor 104, the bottles 102 are moved past a labeling unit 107, on which each label 103, which is coated with glue on its reverse side and held on the periphery of a vacuum drum or label transport cylinder 108, is transferred by its leading label end 103.1 to the bottle 102 which is moving past and is then applied to the surface of the bottle 102 by winding while the bottle 102 rotates and the label 103 is pulled off the vacuum drum or label transport cylinder 108 onto the bottle 102. The labeled bottles 102 are transferred to a container or bottle outlet and to the conveyor 106 to be removed from the labeling unit.

To hold the label 103 on the cylindrical peripheral surface of the vacuum drum or label transport cylinder 108, which is driven around a vertical axis in synchronization with the rotor 104, but in the opposite direction of rotation, i.e. in the direction indicated by the arrow 116, there are vacuum holders 109 and 110, i.e. devices which can also be called vacuum pads, and namely one vacuum holder 109 each for holding a label 103 on its leading label end 103.1 and a vacuum holder 110 for holding each label on the trailing end 103.2. The vacuum holders 109 and 110 are provided in pairs, and possibly in an arc distance which is equal to the length of a label 103.

In the illustrated embodiment, the labels 103 are created by separating them from a strip-format label material **103*a* which is extracted from a supply mechanism (storage spool, not shown) in the direction indicated by the arrow 117. For this purpose, the label material 103*a* is fed to the labeling unit 107 via a plurality of rollers and a motor-driven extraction device 112 and arrives at a cutting roller 113 on which the length that forms the individual label 103 is separated from the label material 103*a* and transferred to the vacuum drum or label transport cylinder 108. Held by the vacuum holder 109 on the vacuum drum or label transport cylinder 108, each label 103 is then moved past a gluing station 114** (not shown) for the application of the glue.

As indicated above, the distance between the forward vacuum pad 109 and the corresponding rear vacuum pad 110 is a function of the length of the labels 103, and this length is in turn a function of the diameter of the bottles 102 in the area in which they are to be provided with the label.

Figure 6A:
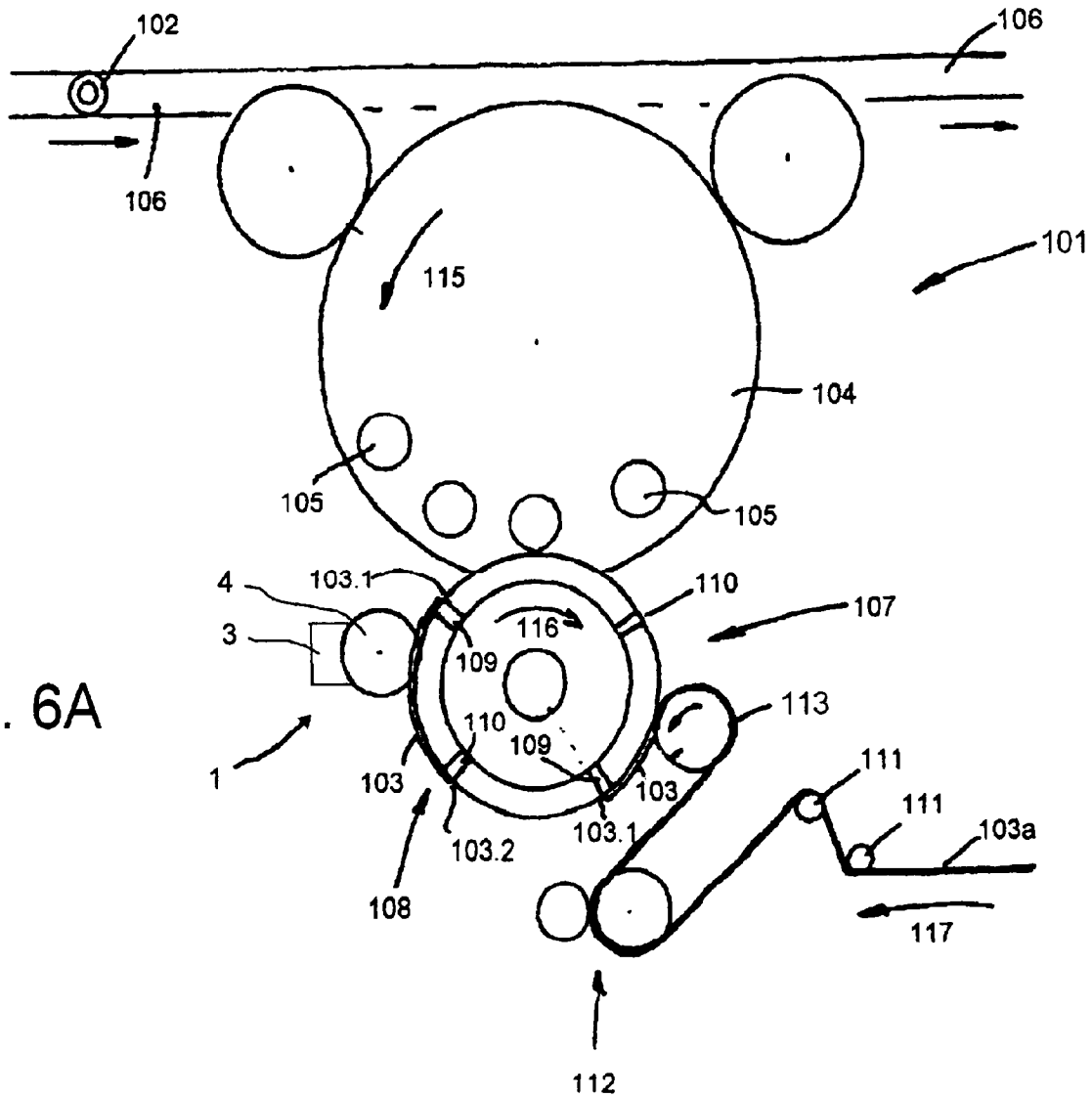
FIG. 6A is a schematic diagram showing an overhead view of a portion of the labeling unit of labeling machine for labeling, including the glue application device of the present application.

FIG. 6A shows the labeling machine 101 similar to that of FIG. 6, with the addition of the glue application device 1 of the present application. The glue application device 1 comprises the gluing roller 4 and the glue application and spreading element 3. The glue application device 1 is disposed between cutting roller 113 and the rotor 104 in the direction of rotation 116, i.e. so that first a label 103 is cut from the label material **103*a* by the cutting roller 113 and is held by the vacuum drum or label transport cylinder 108. Then the label 103 is transferred by the vacuum drum or label transport cylinder 108 to the glue application device 1 for the application of glue by gluing roller 4. Then the label 103 is transferred by the vacuum drum or label transport cylinder 108 to the rotor 104, where the label 103 is applied to a surface of a bottle 102** to be labeled.

In one possible embodiment of the present application, the glue application device may be utilized to deposit or apply glue on a bottle to be labeled. The label would then be applied directly to the bottle and to the glue on the bottle's surface.

Figure 7:
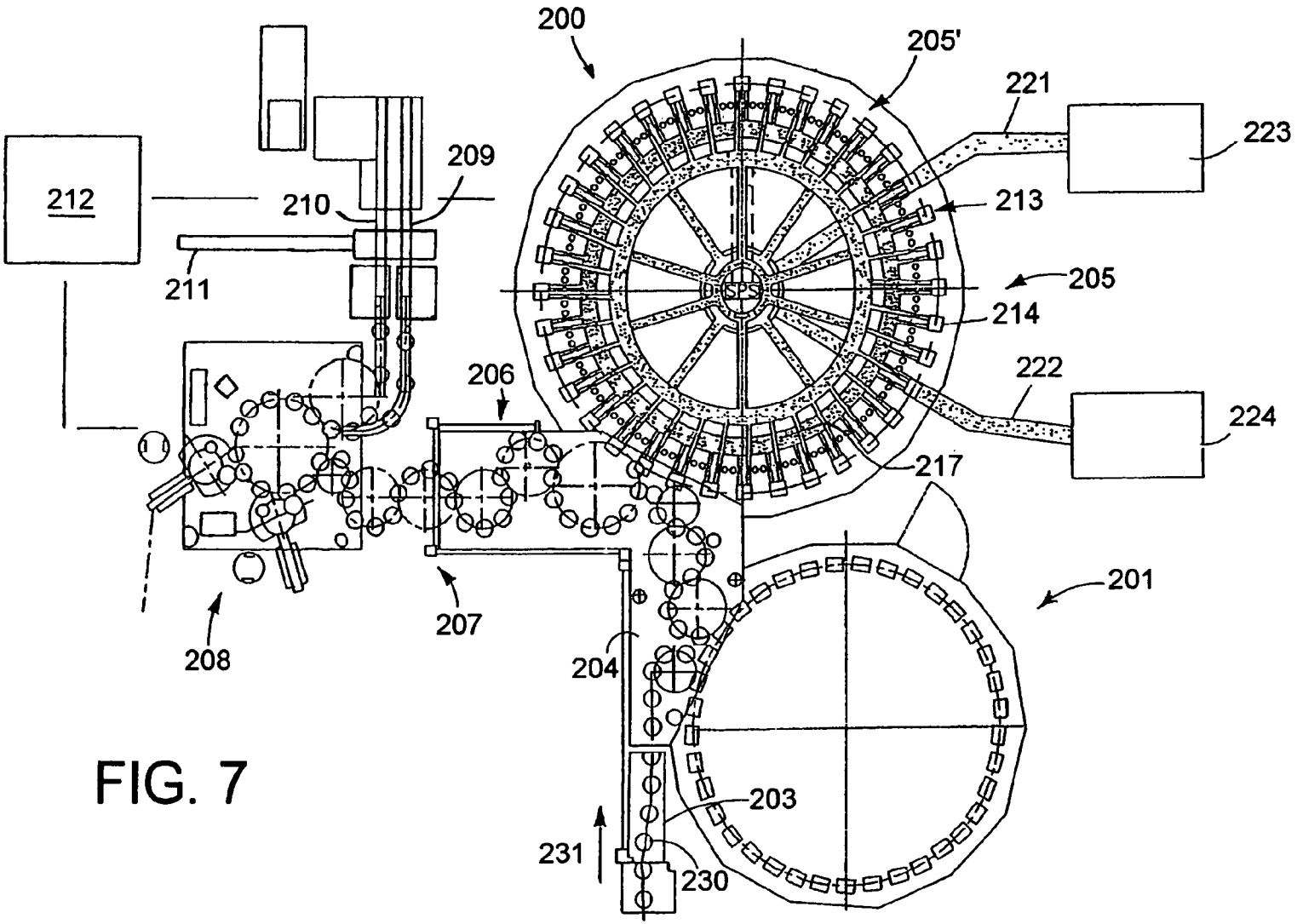
FIG. 7 shows schematically the main components of one possible embodiment of a beverage bottling plant.

FIG. 7 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 7 shows a rinsing arrangement or rinsing station 201, to which the containers, namely bottles 230, are fed in the direction of travel as indicated by the arrow 231, by a first conveyer arrangement 203, which can be a linear conveyor or a combination of a linear conveyor and a starwheel. Downstream of the rinsing arrangement or rinsing station 201, in the direction of travel as indicated by the arrow 231, the rinsed bottles 230 are transported to a beverage filling machine 205 by a second conveyer arrangement 204 that is formed, for example, by one or more starwheels that introduce bottles 230 into the beverage filling machine 205.

The beverage filling machine 205 shown is of a revolving or rotary design, with a rotor 205', which revolves around a central, vertical machine axis. The rotor 205' is designed to receive and hold the bottles 230 for filling at a plurality of filling positions 213 located about the periphery of the rotor 205'. At each of the filling positions 203 is located a filling arrangement 214 having at least one filling device, element, apparatus, or valve. The filling arrangements 214 are designed to introduce a predetermined volume or amount of liquid beverage into the interior of the bottles 230 to a predetermined or desired level.

The filling arrangements 214 receive the liquid beverage material from a toroidal or annular vessel 217, in which a supply of liquid beverage material is stored under pressure by a gas. The toroidal vessel 217 is a component, for example, of the revolving rotor 205'. The toroidal vessel 217 can be connected by means of a rotary coupling or a coupling that permits rotation. The toroidal vessel 217 is also connected to at least one external reservoir or supply of liquid beverage material by a conduit or supply line. In the embodiment shown in FIG. 7, there are two external supply reservoirs 223 and 224, each of which is configured to store either the same liquid beverage product or different products. These reservoirs 223, 224 are connected to the toroidal or annular vessel 217 by corresponding supply lines, conduits, or arrangements 221 and 222. The external supply reservoirs 223, 224 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 214 could be connected by separate connections to each of the two toroidal vessels and have two individually-controllable fluid or control valves, so that in each bottle 230, the first product or the second product can be filled by means of an appropriate control of the filling product or fluid valves.

Downstream of the beverage filling machine 205, in the direction of travel of the bottles 230, there can be a beverage bottle closing arrangement or closing station 206 which closes or caps the bottles 230. The beverage bottle closing arrangement or closing station 206 can be connected by a third conveyer arrangement 207 to a beverage bottle labeling arrangement or labeling station 208. The third conveyor arrangement may be formed, for example, by a plurality of starwheels, or may also include a linear conveyor device.

In the illustrated embodiment, the beverage bottle labeling arrangement or labeling station 208 has at least one labeling unit, device, or module, for applying labels to bottles 230. In the embodiment shown, the labeling arrangement 208 is connected by a starwheel conveyer structure to three output conveyer arrangements: a first output conveyer arrangement 209, a second output conveyer arrangement 210, and a third output conveyer arrangement 211, all of which convey filled, closed, and labeled bottles 230 to different locations.

The first output conveyer arrangement 209, in the embodiment shown, is designed to convey bottles 230 that are filled with a first type of liquid beverage supplied by, for example, the supply reservoir 223. The second output conveyer arrangement 210, in the embodiment shown, is designed to convey bottles 230 that are filled with a second type of liquid beverage supplied by, for example, the supply reservoir 224. The third output conveyer arrangement 211, in the embodiment shown, is designed to convey incorrectly labeled bottles 230. To further explain, the labeling arrangement 208 can comprise at least one beverage bottle inspection or monitoring device that inspects or monitors the location of labels on the bottles 230 to determine if the labels have been correctly placed or aligned on the bottles 230. The third output conveyer arrangement 211 removes any bottles 230 which have been incorrectly labeled as determined by the inspecting device.

The beverage bottling plant can be controlled by a central control arrangement 212, which could be, for example, computerized control system that monitors and controls the operation of the various stations and mechanisms of the beverage bottling plant.

The present application was described above on the basis of one possible embodiment. It goes without saying that numerous modifications as well as variations are possible without thereby going beyond the teaching of the present application.

This present application relates to a glue application device with at least one gluing roller which can be driven in rotation around its roller axis, and with at least one glue application and spreading element for the application of glue on a cylindrical peripheral surface of the gluing roller which concentrically surrounds the roller axis.

One feature or aspect of an embodiment is believed at the time of the filing of this patent application to possibly reside broadly in a glue application device with at least one gluing roller 4 which can be driven in rotation around its roller axis, and with at least one glue application and spreading element 3 with a glue dispensing point which is in communication with a connection 16 for the delivery of the glue to apply glue on a cylindrical peripheral surface of the gluing roller 4 that concentrically surrounds the roller axis and is moved past the glue dispensing point, wherein the glue dispensing point is formed by a glue chamber 8 which has the glue application and spreading element 3 in the vicinity of a contact surface 7 which is in contact against the peripheral surface of the gluing roller 4, and which is closed on its side facing the gluing roller 4 by the peripheral surface of the gluing roller 4.

One feature or aspect of an embodiment is believed at the time of the filing of this patent application to possibly reside broadly in a glue application device with at least one gluing roller 4, which can be driven in rotation around its roller axis, and with at least one glue application and spreading element 3 with a glue dispensing point which is in communication with a connection 16 for the delivery of the glue to apply glue on a cylindrical peripheral surface of the gluing roller 4 that concentrically surrounds the roller axis and is moved past the glue dispensing point, comprising a glue buffer chamber 13 which is in communication with the glue dispensing point at the gluing roller 4 and holds a buffer volume of glue.

One feature or aspect of an embodiment is believed at the time of the filing of this patent application to possibly reside broadly in a glue application device with at least one gluing roller 4 which can be driven in rotation around its roller axis, and with at least one glue application and spreading element 3 with a glue dispensing point which is in communication with a connection 16 for the delivery of the glue to apply glue on a cylindrical peripheral surface of the gluing roller 4 that concentrically surrounds the roller axis and is moved past the glue dispenser, comprising an overflow 14 which is formed between the connection 16 for the feed and glue chamber 8 for the removal of an excess quantity of glue that is not deposited on the gluing roller 4 into an overflow duct 15, possibly into an overflow 15 that leads into a glue reservoir 21 that supplies the glue application device.

One feature or aspect of an embodiment is believed at the time of the filing of this patent application to possibly reside broadly in a glue application device with at least one gluing roller 4 which can be driven in rotation around its roller axis, and with at least one glue application and spreading element 3 with a glue dispensing point which is in communication with a connection 16 for the delivery of the glue to apply glue on a cylindrical peripheral surface of the gluing roller 4 that concentrically surrounds the roller axis and is moved past the glue dispenser, comprising an overflow 14 which is formed between the connection 16 for the feed and delivery of the glue 8 for the removal of an excess quantity of glue that is not deposited on the gluing roller 4 into an overflow duct 15, possibly into an overflow 15 that leads into a glue reservoir 21 that supplies the glue application device.

Another feature or aspect of an embodiment is believed at the time of the filing of this patent application to possibly reside broadly in the glue application device, wherein the glue dispensing point is formed by a glue chamber 8 which has the glue application and spreading element 3 in the vicinity of a contact surface 7 which is in contact against the peripheral surface of the gluing roller 4 and which is closed on its side facing the gluing roller 4 by the peripheral surface of the gluing roller 4.

Yet another feature or aspect of an embodiment is believed at the time of the filing of this patent application to possibly reside broadly in the glue application device, comprising a glue buffer chamber 13 which is in communication with the glue dispensing point to the gluing roller 4, which buffer chamber 13 holds a buffer volume of glue.

Still another feature or aspect of an embodiment is believed at the time of the filing of this patent application to possibly reside broadly in the glue application device, comprising an overflow 14 formed between the connection 16 for the feed of the glue and the glue delivery 8 for the drainage of an excess quantity of glue not applied to the gluing roller 4 into an overflow duct 15, possibly into an overflow 15 which leads into a glue reservoir 21 that feeds the glue application device.

A further feature or aspect of an embodiment is believed at the time of the filing of this patent application to possibly reside broadly in the glue application device, wherein a ventilation opening or a ventilation duct 22 is provided on the glue buffer chamber 13 and/or on the overflow 14.

Another feature or aspect of an embodiment is believed at the time of the filing of this patent application to possibly reside broadly in the glue application device, wherein the glue buffer chamber 13 is provided in the communication between the connection 16 for the feed of the glue and the glue dispensing point 8 to the gluing roller 4.

Yet another feature or aspect of an embodiment is believed at the time of the filing of this patent application to possibly reside broadly in the glue application device, wherein the overflow 14 is formed on the buffer chamber 13.

Still another feature or aspect of an embodiment is believed at the time of the filing of this patent application to possibly reside broadly in the glue application device, wherein the glue buffer chamber 13 is formed by a recess in a housing 3.1 or in a block 23 that forms this housing, and that the overflow 14 is formed by a widened portion of the recess that forms the glue buffer chamber 13 on the upper peripheral area of this recess.

A further feature or aspect of an embodiment is believed at the time of the filing of this patent application to possibly reside broadly in the glue application device, wherein the connection 16 for the feed of the glue empties into the glue buffer chamber 13, possibly on the upper side of this chamber.

Another feature or aspect of an embodiment is believed at the time of the filing of this patent application to possibly reside broadly in the glue application device, wherein the glue chamber 8 is realized in the form of an elongated chamber and is oriented with its longitudinal dimension parallel or approximately parallel to the roller axis of the gluing roller 4.

Yet another feature or aspect of an embodiment is believed at the time of the filing of this patent application to possibly reside broadly in the glue application device, comprising a glue duct 11 which connects the glue chamber 8 with the glue buffer chamber 13.

Another feature or aspect of an embodiment is believed at the time of the filing of this patent application to possibly reside broadly in the glue application device, wherein the glue duct 11 empties on the bottom of the glue buffer chamber 13 of this chamber.

Yet another feature or aspect of an embodiment is believed at the time of the filing of this patent application to possibly reside broadly in the glue application device, wherein the glue chamber 8 is connected with the glue duct 11 by means of a plurality of openings or borings 12.

Still another feature or aspect of an embodiment is believed at the time of the filing of this patent application to possibly reside broadly in the glue application device, comprising a heater 6 in the glue application or distribution element 3.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of labeling machines which may possibly be utilized in at least one possible embodiment may possibly be found in the following U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,543,514, entitled "In-line continuous feed sleeve labeling machine and method;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,263,940, entitled "In-line continuous feed sleeve labeling machine and method;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled "Labeling machine and method; U.S. Pat. No. 6,050,319, entitled "Non-round container labeling machine and method;" and U.S. Pat. No. 6,045,616, entitled "Adhesive station and labeling machine."

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

Some examples of glue pumps which may be possibly utilized in at least one possible embodiment of the present application may possibly be found in the following U.S. Pat. No. 4,537,586, published on Aug. 27, 1985, having the title "METHOD AND APPARATUS FOR APPLYING COUPON STRIPS TO PAPER BAGS;" U.S. Pat. No. 5,730,819, published on Mar. 24, 1998, having the title "DISPENSING APPARATUS AND METHOD FOR DISPENSING FLUID MATERIAL TO A SURFACE;" U.S. Pat. No. 4,430,147, published on Feb. 7, 1984, having the title "HOLT MELT ADHESIVE APPLICATORS;" and U.S. Pat. No. 3,942,686, published on Mar. 9, 1976, having the title "GLUING DEVICE."

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

Some examples of heaters which may possibly be utilized in at least one possible embodiment of the present application may possibly be found in the following U.S. Pat. No. 5,688,363, published on Nov. 18, 1997, having the title "LABELLING MACHINE;" U.S. Pat. No. 4,119,058, published on Oct. 10, 1978, having the title "GLUE APPLICATORS;" U.S. Pat. No. 3,892,339, published on Jul. 1, 1975, having the title "EQUIPMENT FOR POINT BY POINT APPLICATION OF AN ADHESIVE;" and U.S. Pat. No. 3,603,286, published on Sep. 7, 1971, having the title "COATING APPARATUS."

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

Some examples of glues and/or adhesives which may possibly be used in at least one possible embodiment of the present application may possibly be found in the following U.S. Pat. No. 6,641,911, published on Nov. 4, 2003, having the title "USE OF SELECTED ADHESIVE MIXTURES FOR OVERLAP ADHESION OF ROUND LABELS WHEN APPLIED TO PLASTIC BOTTLES;" U.S. Pat. No. 6,590,019, published Jul. 8, 2003, having the title "AQUEOUS ADHESIVE COMPOSITIONS USEFUL AS BOTTLE LABELING ADHESIVES;" U.S. Pat. No. 5,455,066, published on Oct. 3, 1995, having the title "WATER-CONTAINING ADHESIVE BASED ON CASEIN;" and U.S. Pat. No. 5,360,854, published on Nov. 1, 1994, having the title "HOLT MELT PRESSURE SENSITIVE ADHESIVE COMPOSITION AND APPLICATIONS."

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

U.S. patent application Ser. No. 12/235,668, filed on Sep. 23, 2008, having inventor Klaus KRÄMER, and title "LABELING MACHINE, A VACUUM DRUM FOR USE NI A LABELING MACHINE, AND A METHOD OF USING A LABELING MACHINE HAVING A VACUUM DRUM", and its corresponding Federal Republic of Germany Patent Application No. 10 2006 013 844.9, filed on Mar. 25, 2006, and International Patent Application No. PCT/EP2007/002579, filed on Mar. 23, 2007, having WIPO Publication No. WO 2007/110199 and inventor Klaus KRÄMER, are hereby incorporated by reference as if set forth in their entirety herein.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

All of the patents, patent applications or patent publications, which were cited in the International Search Report dated Aug. 13, 2007, and/or cited elsewhere are hereby incorporated by reference as if set forth in their entirety herein as follows: U.S. Pat. No. 4,347,095, published Aug. 31, 1982, having the title "ADHESIVE APPLICATOR;" DE 202 20 132, published Apr. 15, 2004, having the English translation of the German title "ADHESIVE APPLICATOR FOR LABELLING MACHINE, INCLUDES SCRAPER FOR REMOVING ADHESIVE RESIDUE AND FOREIGN BODIES FROM ROLL;" DE 12 40 775, published on May 18, 1967, having the German title "VORRICHTUNG ZUM UEBERSCHUSSFREIEN ZUFUEHREN VON KLEBSTOFFEN;" U.S. Pat. No. 4,693,210, published on Sep. 15, 1987, having the title "QUICK CHANGE FOUNTAIN;" and U.S. Pat. No. 5,160,570, published on Nov. 3, 1992, having the title "ULTRA HIGH SPEED LABELING APPARATUS."

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 017 365.1, filed on Apr. 11, 2006, having inventors Lutz DECKERT, Klaus KRÄMER, and Oliver KRESS, and DE-OS 10 2006 017 365.1 and DE-PS 10 2006 017 365.1, and International Application No. PCT/EP2007/002736, filed on Mar. 28, 2007, having WIPO Publication No. WO 2007/118582 and inventors Lutz DECKERT, Klaus KRÄMER, and Oliver KRESS, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/002736 and German Patent Application 10 2006 017 365.1 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/002736 and German patent application 10 2006 017 365.1 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

PARTIAL LIST OF NOMENCLATURE

1 Glue application device
2 Label
3 Glue application and spreading element
3.1 Housing
4 Gluing roller
5 Label transport cylinder
6 Heater device
7 Contact surface
8 Glue chamber
9 Bottom of the glue chamber
10 Peripheral surface of the glue chamber
11 Glue duct
12 Boring
13 Glue buffer chamber
14 Overflow
15 Overflow duct
16 Connection
17 Bracket
18 Compression spring
19 Wiper
20 Glue scraper
21 Glue pan
22 Vent
23 Housing block
24 Cover
A Direction of rotation of the gluing roller 4

What is claimed is:

1. Glue application device with at least one gluing roller (4) which can be driven in rotation around its roller axis, and with at least one glue application and spreading element (3) with a glue dispensing point which is in communication with a connection (16) for the delivery of the glue to apply glue on a cylindrical peripheral surface of the gluing roller (4) that concentrically surrounds the roller axis and is moved past the glue dispensing point, wherein said glue application device comprises a glue buffer chamber (13) which is in communication with the glue dispensing point at the gluing roller (4) and holds a buffer volume of glue.

2. Glue application device as recited in claim 1, wherein said glue application device comprises a ventilation opening or a ventilation duct (22) for the release of air from said glue buffer chamber (13).

3. Glue application device as recited in claim 2, wherein said glue application device comprises an overflow (14) formed between the connection (16) for the feed of the glue and the glue delivery (8) for the drainage of an excess quantity of glue not applied to the gluing roller (4) into an overflow duct (15), preferably into an overflow (15) which leads into a glue reservoir (21) that feeds the glue application device.

4. Glue application device as recited in claim 3, wherein said ventilation opening or ventilation duct (22) is provided on the glue buffer chamber (13) and/or on the overflow (14).

5. Glue application device as recited in claim 4, wherein the glue buffer chamber (13) is provided in the communication between the connection (16) for the feed of the glue and the glue dispensing point to the gluing roller (4).

6. Glue application device as recited in claim 5, wherein the overflow (14) is connected to the buffer chamber (13).

7. Glue application device as recited in claim 6, wherein:

the glue buffer chamber (13) is formed by a recess in a housing (3.1) or in a block (23) that forms this housing, and that the overflow (14) is formed by a widened portion of the recess that forms the glue buffer chamber (13) on the upper peripheral area of this recess; and the connection (16) for the feed of the glue empties into the glue buffer chamber (13), preferably on the upper side of this chamber.

8. Glue application device as recited in claim 7, wherein:

said glue application device comprises a glue duct (11) which is connected to the glue buffer chamber (13);

the glue duct (11) empties on the bottom of the glue buffer chamber (13) of this chamber; and said glue application device comprises a heater (6) in the glue application or distribution element (3).

9. Glue application device with at least one gluing roller (4) which can be driven in rotation around its roller axis, and with at least one glue application and spreading element (3) with a glue dispensing point which is in communication with a connection (16) for the delivery of the glue to apply glue on a cylindrical peripheral surface of the gluing roller (4) that concentrically surrounds the roller axis and is moved past the glue dispensing point, wherein said glue application device comprises an overflow (14) which is formed between the connection (16) for the feed and delivery of the glue (8) for the removal of an excess quantity of glue that is not deposited on the gluing roller (4) into an overflow duct (15), preferably into an overflow (15) that leads into a glue reservoir (21) that supplies the glue application device.

10. Glue application device as recited in claim 9, wherein the glue dispensing point is formed by a glue chamber (8) which has the glue application and spreading element (3) in the vicinity of a contact surface (7) which is in contact against the peripheral surface of the gluing roller (4) and which is closed on its side facing the gluing roller (4) by the peripheral surface of the gluing roller (4).

11. Glue application device as recited in claim 10, wherein a ventilation opening or a ventilation duct (22) is provided on the overflow (14).

12. Glue application device as recited in claim 11, wherein:

the glue chamber (8) is realized in the form of an elongated chamber and is oriented with its longitudinal dimension parallel or approximately parallel to the roller axis of the gluing roller (4);

said glue application device comprises a glue duct (11) which is connected to the glue chamber (8);

the glue chamber (8) is connected with the glue duct (11) by means of a plurality of openings or borings (12); and said glue application device comprises a heater (6) in the glue application or distribution element (3).

13. Glue application device with at least one gluing roller (4) which can be driven in rotation around its roller axis, and with at least one glue application and spreading element (3) with a glue dispensing point which is in communication with a connection (16) for the delivery of the glue to apply glue on a cylindrical peripheral surface of the gluing roller (4) that concentrically surrounds the roller axis and is moved past the glue dispensing point, wherein the glue dispensing point is formed by a glue chamber (8) which has the glue application and spreading element (3) in the vicinity of a contact surface (7) which is in contact against the peripheral surface of the gluing roller (4), and which is closed on its side facing the gluing roller (4) by the peripheral surface of the gluing roller (4), wherein said glue application device comprises a heater (6) disposed within the glue application or distribution element (3).

14. Glue application device as recited in claim 13, wherein:

said glue application device comprises a glue buffer chamber (13) which is in communication with the glue dispensing point to the gluing roller (4), which buffer chamber (13) holds a buffer volume of glue;

said glue application device comprises a glue duct (11) which connects the glue chamber (8) with the glue buffer chamber (13); and said heater (6) is disposed adjacent and to extend along said glue duct (11) to heat glue prior to entry into said glue chamber (8).

15. Glue application device as recited in claim 14, wherein:

the glue chamber (8) is realized in the form of an elongated chamber and is oriented with its longitudinal dimension parallel or approximately parallel to the roller axis of the gluing roller (4);

the glue chamber (8) is connected with the glue duct (11) by means of a plurality of openings or borings (12);

said heater (6) is an elongated heater (6) disposed to extend along the length of said glue chamber (8) to heat glue being conducted through each of said plurality of openings or borings (12); and each of said plurality of openings or borings (12) is disposed at substantially the same distance from said heater (6).

16. Glue application device as recited in claim 15, wherein said glue application device comprises an overflow (14) formed between the connection (16) for the feed of the glue and the glue delivery (8) for the drainage of an excess quantity of glue not applied to the gluing roller (4) into an overflow duct (15), preferably into an overflow (15) which leads into a glue reservoir (21) that feeds the glue application device, and a ventilation opening or a ventilation duct (22) is connected directly to one of: the glue buffer chamber (13) and the overflow (14).

17. Glue application device as recited in claim 16, wherein:

the glue buffer chamber (13) is provided in the communication between the connection (16) for the feed of the glue and the glue dispensing point (8) to the gluing roller (4);

the overflow (14) is connected to the buffer chamber (13); and the glue buffer chamber (13) is formed by a recess in a housing (3.1) or in a block (23) that forms this housing, and that the overflow (14) is formed by a widened portion of the recess that forms the glue buffer chamber (13) on the upper peripheral area of this recess.

18. Glue application device as recited in claim 17, wherein:

the connection (16) for the feed of the glue empties into the glue buffer chamber (13), preferably on the upper side of this chamber;

the glue duct (11) empties on the bottom of the glue buffer chamber (13) of this chamber; and said heater (6) is configured and disposed to maintain substantially constant temperature of the glue being conducted through each of said plurality of openings or borings (12) and into said glue chamber (8).

19. Glue application device as recited in claim 13, wherein:

said glue application device comprises a plurality of openings or borings (12) through which glue is conducted into said glue chamber (8); and said heater (6) is configured and disposed to maintain substantially constant temperature of the glue being conducted through each of said plurality of openings or borings (12) and into said glue chamber (8).

20. Glue application device as recited in claim 13, wherein:

said glue application device comprises a plurality of openings or borings (12) through which glue is conducted into said glue chamber (8);

said heater (6) is an elongated heater (6) disposed to extend along the length of said glue chamber (8) to heat glue being conducted through each of said plurality of openings or borings (12); and each of said plurality of openings or borings (12) is disposed at substantially the same distance from said heater (6).

* * * * *